US006255779B1

(12) United States Patent
Ha et al.

(10) Patent No.: US 6,255,779 B1
(45) Date of Patent: Jul. 3, 2001

(54) COLOR PLASMA DISPLAY PANEL WITH BUS ELECTRODE PARTIALLY CONTACTING A TRANSPARENT ELECTRODE

(75) Inventors: Hong-Ju Ha; Hun-Gun Park, both of Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/219,532

(22) Filed: Dec. 23, 1998

(30) Foreign Application Priority Data

Dec. 26, 1997 (KR) ..... 97-74568

(51) Int. Cl.[7] ..... H01J 17/49

(52) U.S. Cl. ..... 313/582; 313/584; 313/585; 313/491

(58) Field of Search ..... 313/582, 583, 313/584, 585, 586, 587

(56) References Cited

U.S. PATENT DOCUMENTS 5,742,122 * 4/1998 Amemiya et al. ..... 313/582
5,754,004 * 5/1998 Miyagawa et al. ..... 313/585
6,031,329 * 2/2000 Nagano ..... 313/582

* cited by examiner

*Primary Examiner*—Michael H. Day
*Assistant Examiner*—Mack Haynes
(74) *Attorney, Agent, or Firm*—Fleshner & Kim, LLP

(57) ABSTRACT

Provided with an electrode of a color plasma display panel including a plurality of sustain discharge electrodes forming pairs of electrodes for causing a mutual discharge on the one of two substrates being bonded together and spaced form each other at a predetermined distance, in which each of the sustain discharge electrodes is composed of transparent electrodes adjacent to each other; and metal electrodes formed on the outer side of and spaced at a predetermined distance from the transparent electrodes, the metal electrodes partly being in contact with the transparent electrodes.

3 Claims, 4 Drawing Sheets

COLOR PLASMA DISPLAY PANEL WITH BUS ELECTRODE PARTIALLY CONTACTING A TRANSPARENT ELECTRODE

BACKGROUND OF THE INVENTION

1. Field of the Invention

The present invention generally relates to a plasma display panel (PDP) which is a kind of light-emitting devices for displaying an image by using a gas discharge between glass substrates and, more particularly, to an improved structure of discharge sustain electrodes forming a pair of electrodes a color PDP having an internal structure improved to increase aperture rate of the front panel which is an image displaying surface and maximize the efficiency of light emission using discharge between electrodes.

2. Discussion of Related Art

In general, color PDPs are a kind of light-emitting device for displaying an image by use of internal gas discharge and advantageous such as no needs to provide active elements in every cells, simple fabricating process, large-sized screen and high response speed. So, color PDPs are a promising display device having a wide screen, especially, wall TV and the next generation high definition television (HDTV) and used for television, monitor, interior/exterior advertisement display device and the like.

In addition, PDPs are easy to be enhanced in size relative to the existing liquid crystal displays and in the highlight in the field of large-sized display device to above 40 inches. The schematic structure of PDPs includes two glass substrates bonded together with a frit glass and sealed to form an integrated body.

Thus sealed internal space is filled with a gas under the pressure of 100–600 Torr and the gas is usually a fanning gas containing xenon (Xe) in helium (He).

The image display section of a panel has intersections between a plurality of electrodes in correspondence to the pixels (cells). When driving the panel, a voltage greater than 100 volts is applied to the intersections, causing glow discharge of gas and emitting lights, to display an image. This panel section is combined with a driving section to serve as a display device.

Such PDPs are classified into two-, three- and four-electrode types according to the number of electrodes allotted to each cell: the two-electrode type PDP is driven by applying an addressing and sustain voltage to two electrodes, and the three-electrode type PDP is generally called "surface discharge type" and switched or maintained by a voltage applied to the electrode positioned on the lateral side of a discharge cell.

An example of the related art three-electrode surface discharge PDP will be described below in reference with FIGS. 1 to 3.

FIG. 1 is an exploded view of a PDP structure having upper and lower substrates. In the figure, a front substrate 1 which is an image displaying surface is combined in parallel with a back substrate 2 at a predetermined distance.

The front substrate 1 is provided with a discharge sustain electrode formed with a pair of common electrode C and scan electrode S. The discharge sustain electrode is to sustain light-emission of cells by means of mutual discharge in one pixel. The front substrate 1 is also provided with a dielectric layer 5 for restraining discharge current of the two electrodes and insulating between electrode pairs, and a protective layer 6 formed on the dielectric layer 5.

The back substrate 2 includes a plurality of spaces for discharge, that is, separate walls 3 defining cells, a plurality of address electrodes A formed in the direction parallel with the separate walls 3 for performing address discharge at the intersections with scan electrodes S to cause vacuum ultra-violet rays, and a fluorescent layer 4 formed on the lateral sides of separate walls 3 and on the back substrates out of the internal surface of each discharge space for emitting visible rays to display images during address discharge, The discharge sustain electrodes constituting a pair of electrodes are, as shown in FIG. 2, about 300 micrometers in width and include ITO electrode 7 and BUS electrode 8. ITO electrode 7 consists of a transparent material and causes a mutual surface discharge in the related discharge cell when a discharging voltage is applied to both terminals thereof. BUS electrode 8 being about 50 to 100 micrometers in width is made of metal and formed on the ITO electrode 7 in order to prevent a voltage drop caused by the resistance of the ITO electrode.

FIG. 2 illustrates the arrangement of common electrodes C, scan electrodes S and address electrodes A. And, FIG. 3 is a cross-sectional view of a cell after the upper and lower substrates are bonded together to form an integrated body, in which the lower substrate is rotated at 90 degrees expediently for better understanding.

First, when a discharging voltage is applied between scan electrode S and common electrode C that form a pair of electrodes in the cell, a surface discharge occurs between the two electrodes to form wall charges on the internal surface of the discharge space Following the surface discharge, applying an address discharge voltage to scan electrode S and address electrode A causes a writing discharge to occur in the cell. Subsequently, a sustain discharge voltage is applied to scan electrode S and common electrode C, which causes a sustain discharge due to charged particles generated in the address discharge between address electrode A and scan electrode S, sustaining light-emission of the cell for a predetermined period of time That means, the electric field is formed in the cell due to a discharge between the electrodes such that a minute quantity of electrons contained in the discharge gas are accelerated and collide with neutral particles in the gas to ionize, which are ionized into ions and electrons. Thus generated electrons collide with another neutral particles to produce more electrons and ions, The discharge gas is changed into plasma and vacuum ultra-violet rays occur. The generated ultra-violet rays excite the fluorescent layer 4 to emit visible rays, which are projected to the outside through the front substrate 1 to cause light-emission in a cell.

Especially, the related art discharge sustain electrodes have a structure in which BUS electrode 8 having a low resistance is formed in contact with high resistance ITO electrode 7. The most of voltage is applied via the low resistance BUS electrode 8 during a sustain discharge between scan electrode S and common electrode C so that the mutual discharge area (a) gradually appears from the center of the cell.

In such a conventional structure, however, the resistance of discharge sustain electrode affects the whole line uniformly and the discharge energy is consumed even at the boundary of the discharge cells that has little contribution to the discharge.

This reduces discharge efficiency in the discharge cells and adversely affects the luminance of images.

SUMMARY OF THE INVENTION

Accordingly, the present invention is directed to an electrode of a color plasma display panel that substantially obviates one or more of the problems due to limitations and disadvantages of the related art.

An object of the present invention is to cause a discharge between discharge sustain electrodes to occur in the center of each discharge cell.

Another object of the present invention is to reduce power consumption of PDPs and enhance discharge efficiency by controlling contact between ITO and BUS electrodes so as to apply less discharge current to the boundary of cells.

Additional features and advantages of the invention will be set forth in the description which follows, and in part will be apparent from the descriptions or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an electrode of a color plasma display panel includes a plurality of sustain discharge electrodes forming pairs of electrodes for causing a mutual discharge on the one of two substrates being bonded together and spaced from each other at a predetermined distance. Each of the sustain discharge electrodes includes: transparent electrodes, that is, ITO electrodes adjacent to each other; and metal electrodes, that is, BUS electrodes formed on the outer side of and spaced at a predetermined distance from the transparent electrodes, the metal electrodes partly being in contact with the transparent electrodes.

Preferably, the metal electrodes are in contact with the transparent electrodes at the intersections of the electrodes on the other substrate.

Alternatively, the metal electrodes are in contact with the transparent electrodes at the one side of the sustain discharge electrodes causing a mutual discharge.

With this, a sustain discharge begins to occur at the center of each discharge cell as the resistance becomes minimum at the contact of metal electrodes out of the transparent electrodes. The discharge is spread gradually but restrained at the boundary of the discharge cells where the resistance of the transparent electrodes increases because the metal electrodes are not in contact.

Consequently, the discharge area between the discharge sustain electrodes is concentrated on the center of each discharge cell, which makes it possible to prevent a loss of current required for the discharge, enhancing discharge efficiency.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

Figure 1:
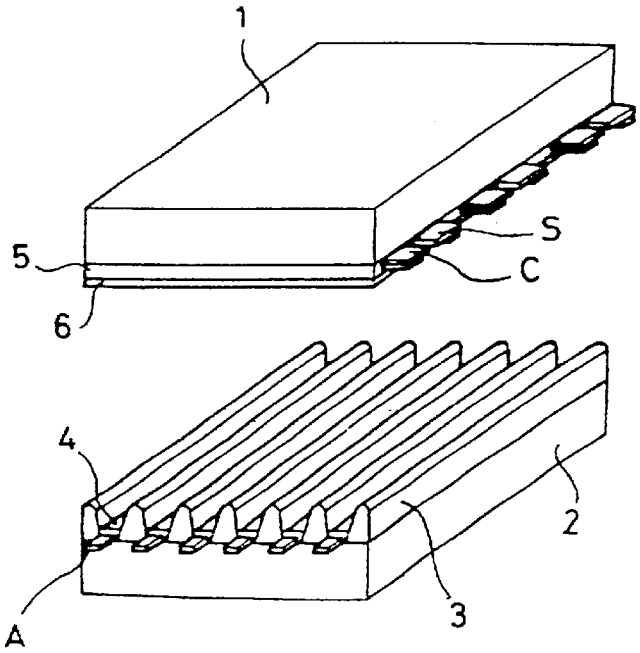
FIG 1 PRIOR ART
FIG. 1 is an exploded perspective of the prior art PDP having upper and lower substrates.
Figure 2:
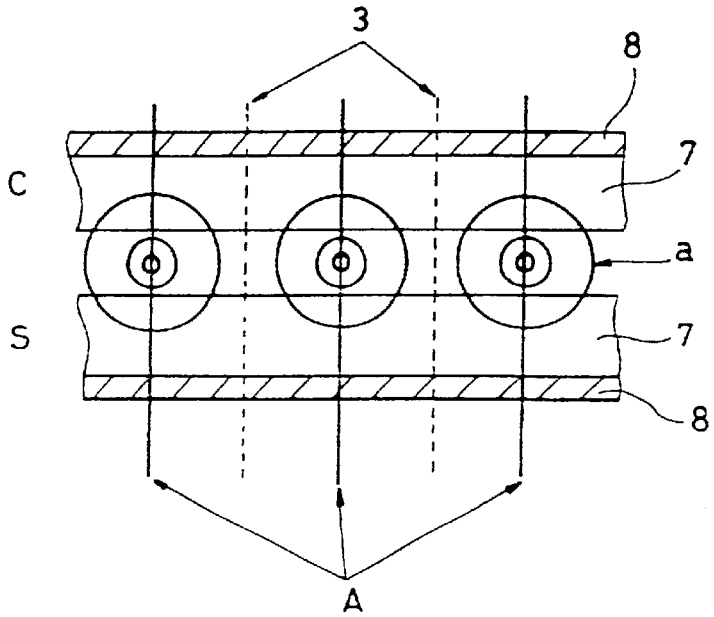
FIG 2 PRIOR ART
FIG. 2 shows an arrangement of discharge electrodes of the PDP.
Figure 3:
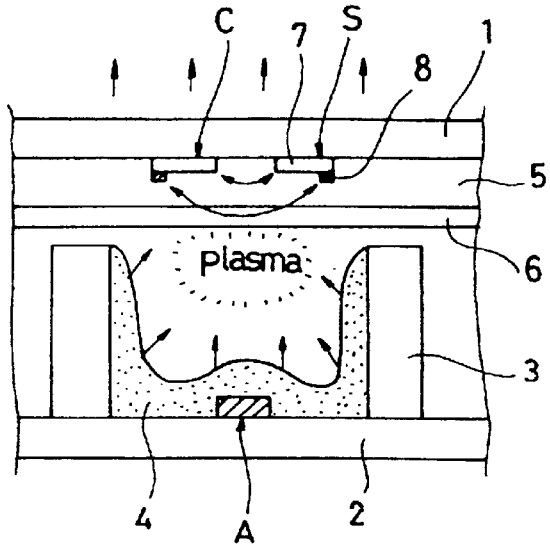
FIG 3 PRIOR ART
FIG. 3 is a cross-sectional view of a discharge cell according to prior art.
Figure 4:
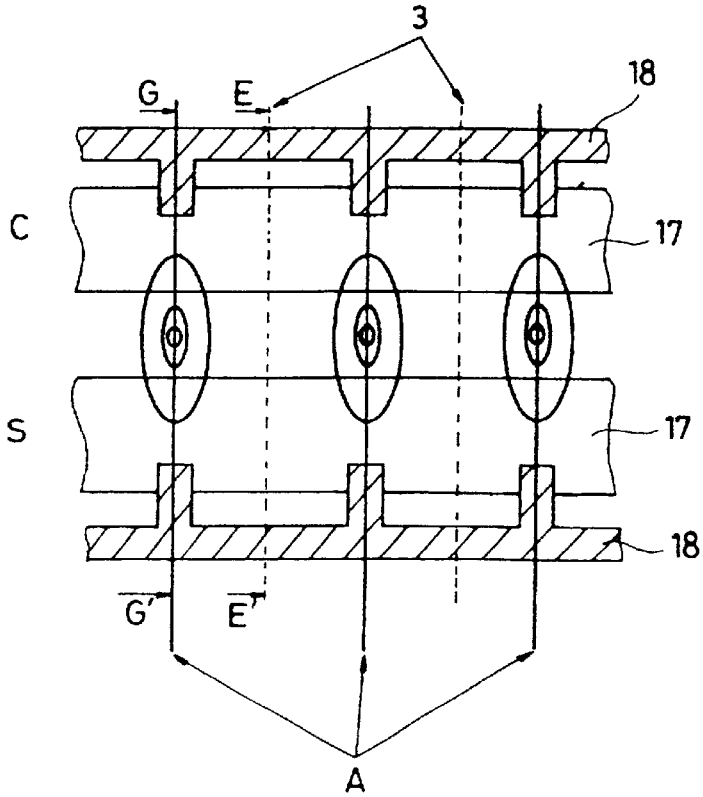
FIG. 4 is an enlarged view showing a discharge cell of a PDP according to the present invention.
Figure 5A:
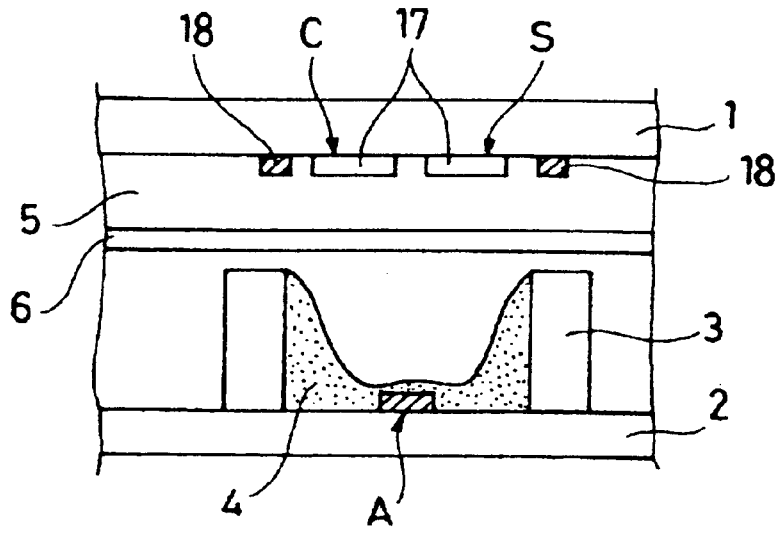
Figure 5B:
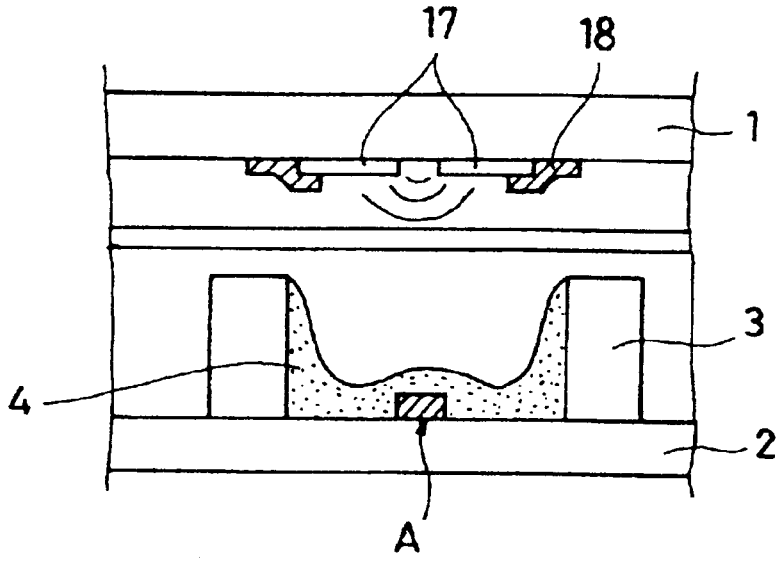
Figure 6:
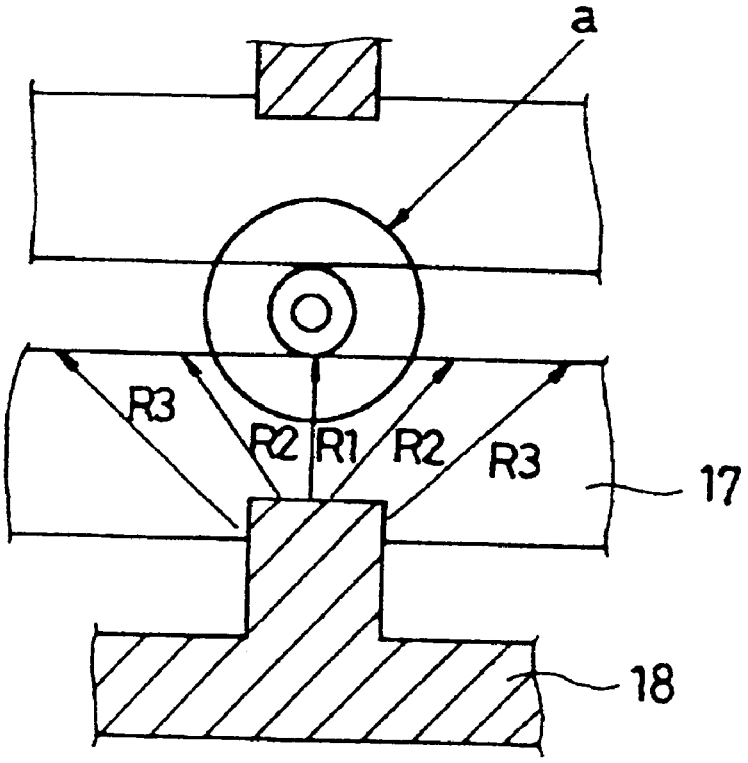

FIG. 5*a* is a cross-sectional view of the cell taken along the line E–E' of FIG. 4;

FIG. 5*b* is a cross-sectional view of the cell taken along the line G–G' of FIG. 4; and FIG. 6 shows the dispersion of a discharge according to the present invention.

DETAILED DESCRIPTION OF PREFERRED EMBODIMENT

Reference will now be made in detail to the preferred embodiments of the present invention, several examples of which are illustrated in the accompanying drawings.

These preferred embodiments will help better understanding of the objects, characteristics and effects of the present invention.

Hereafter, the preferred embodiments of the present invention structure of a discharge sustain electrode will be described in connection with the attached drawings.

In the drawings, the same reference numeral denotes the same component.

FIG. 4 illustrate the structure of a discharge sustain electrode according to the preferred embodiment of the present invention. FIGS. 5*a* and 5*b* are cross-sectional views showing the principal parts of a cell, in which the upper of lower substrate is rotated at 90 degrees expediently for better understanding. FIG. 6 shows the dispersion of a discharge.

As shown in FIG. 4, the discharge sustain electrode according to the preferred embodiment of the present invention includes BUS electrode 18 formed along and spaced from ITO electrode 17 at a predetermined distance. The BUS electrode 18 projects from the center of each discharge cell and is in contact with ITO electrode 17.

Reference numeral 3 indicated by a dotted line denotes separate walls. Between the separate walls is arranged an address electrode A in parallel.

With the construction, applying an address discharging voltage to scan electrode S and address electrode A causes the cell to emit a light and a voltage is applied between discharge sustain electrodes C and S. Then a sustain discharge occurs.

At a time the resistance of discharge sustain electrodes becomes minimum through R1 at the contact with BUS electrode 18, a discharge between the electrodes begins at the area. The discharge area (a) increases gradually towards the position R2 and is restrained at R3 which is too distant from R1 and hard to attain spread of discharge.

This phenomenon appears in every discharge cells uniformly and the discharge area of the display panel is possible to control It is also possible to enhance discharge efficiency since the discharging current is restrained between the discharge cells That means, the discharge area is automatically restrained by use of the resistance difference on the ITO electrode so as to prevent an excessive increase of the discharge area, thereby reducing consumption of energy required for a discharge and enhancing discharge efficiency.

Contrary to the related structure of discharge sustain electrodes by which the resistance is uniform in the entire electrode line and the discharge energy is consumed at the boundary of the discharge cells, it is demonstrated that in the present invention the discharge area is concentrated on the center of each discharge cell where the resistance is minimum.

Further, opaque BUS electrode 18 is positioned in the outer side of ITO electrode 17 consisting of a transparent material, which increases the aperture rate of the front substrate 1 to enhance luminance.

As a result, the present invention can prevent an excessive increase of discharge area by restraining the discharge area through sustain electrodes with the resistance of the ITO electrode, enhancing discharge efficiency and luminance of the PDPs.

While the preferred embodiment of the invention has been described, it will be apparent to those skilled in the art that various modifications and variations can be made in the present invention without departing from the spirit or scope of the invention.

Thus, it is intended that the present invention cover the modifications and variations of this invention provided they come within the scope of the appended claims and their equivalents.

What is claimed is:

1. A color plasma display panel including:

a plurality of sustain discharge electrodes forming pairs of electrodes for causing a mutual discharge on one of two substrates which are bonded together and spaced from each other at a predetermined distance, each of the sustain discharge electrodes comprising:

first and second transparent electrode strips adjacent to each other; and first and second metal electrode strips on an outer periphery of and spaced at a predetermined distance from each of the transparent electrode strips, the metal electrode strips including metal portions extending therefrom, the extending portions being in contact with the periphery of the transparent electrode strips.

2. The color plasma display panel as claimed in claim 1, wherein the extending portions of the metal electrode strips are in contact with the transparent electrode strips at the intersection of corresponding electrodes on the other substrate.

3. The color plasma display panel as claimed in claim 1, wherein the extending portions of the metal electrode strips are in contact with the transparent electrode strips at one side of the sustain discharge electrodes causing a mutual discharge.

* * * * *